US006059279A

United States Patent [19]

Wenthe, Jr.

[11] Patent Number: 6,059,279

[45] Date of Patent: May 9, 2000

[54] RETARD SHEET SEPARATOR-FEEDER WITH RETARDED SHEETS KICKBACK REDUCTION

[75] Inventor: Stephen J. Wenthe, Jr., West Henrietta, N.Y.

[73] Assignee: Xerox Corporation, Stamford, Conn.

[21] Appl. No.: 09/152,120

[22] Filed: Sep. 14, 1998

[51] Int. Cl.[7] ..... B65H 5/00

[52] U.S. Cl. ..... 271/10.13; 271/10.11; 271/114; 271/122

[58] Field of Search ..... 271/10.13, 10.11, 271/4.1, 114, 116, 122

[56] References Cited

U.S. PATENT DOCUMENTS

| | | | |
|---|---|---|---|
| 5,158,279 | 10/1992 | Laffey et al. | 271/116 |
| 5,421,569 | 6/1995 | Davidson | 271/109 |
| 5,435,538 | 7/1995 | Billings et al. | 271/34 |
| 5,435,539 | 7/1995 | Namiki | 271/116 |
| 5,534,989 | 7/1996 | Rubscha et al. | 355/309 |
| 5,630,580 | 5/1997 | Tsao et al. | 271/116 |
| 5,709,380 | 1/1998 | Petocchi et al. | 271/125 |
| 5,769,410 | 6/1998 | Davidson et al. | 271/109 |
| 5,984,298 | 11/1999 | Wada et al. | 271/114 |

FOREIGN PATENT DOCUMENTS

| | | | |
|---|---|---|---|
| 0 215 438 | 9/1987 | Japan | 271/116 |

*Primary Examiner*—H. Grant Skaggs

[57] ABSTRACT

A retard sheet feeder-separator for separating and sequentially feeding sheets with a frictional sheet feeding roller, driven via a drive train by an intermittently connected rotational drive system, feeding an individual sheet past an engaging frictional retard roller, forming a sheet retard nip therewith for holding back the other sheets, to a downstream sheet feeding nip. A flywheel having a rotational moment of inertia substantially greater than that of the drive train and the sheet feeding roller is connected to the outer end of the drive train to reduce kickback of the retarded sheets in the retard nip, especially where the retard roller is rotatable forward with a high torque drag but has kickback upon release of a fed sheet from the retard nip. Additionally, a low torque drag system is provided between the drive system and the drive train, operative even when the intermittent sheet feeding drive is disconnected, to bias out any backlash in the drive train between the flywheel and the sheet feeding roller.

7 Claims, 4 Drawing Sheets

RETARD SHEET SEPARATOR-FEEDER WITH RETARDED SHEETS KICKBACK REDUCTION

Disclosed is an improvement in sheet separator-feeders, in particular, those of the sheet retard type, for reducing undesirable amounts of "kickback" of retarded sheet(s) as the feeding sheet is fed out.

One of the most difficult problems in feeding sheets to printers, copiers, and other printing or reproduction apparatus (whether copy sheets being fed to be printed, or original documents sheets being fed to be imaged and stored and/or printed) is feeding the sheets sequentially, only one at a time, at the desired time, from a stack of sheets. That is, to avoid "double feeds", sheet overlaps, nonfeeds, or other misfeeds. Sheets can vary widely in size and weight, stiffness, age, humidity, curl, size and other properties complicating the feeding at the proper time of only one sheet at a time. Copy sheets can even be partially stuck together by "edge welding" of the sheets from the sheet stack edge cutting process or "break".

Some general examples of prior patents on retard-type spring reverse driven retard roller sheet separator-feeders are disclosed in Savin U.S. Pat. No. 4,368,881; and Konika U.S. Pat. No. 5,039,080. Other retard sheet separators and general principles thereof are described in Xerox Corporation U.S. Pat. No. 3,768,803 issued Oct. 30, 1993 to Klaus K. Stange.

Of particular interest to the specific retard separator-feeder of the embodiment herein are Xerox Corporation U.S. Pat. Nos. 5,435,538 issued Jul. 25, 1995 to Philip A. Billings and Ermanno C. Petocchi; 5,421,569 issued Jun. 6, 1995 to Harry A. Davidson; 5,709,380 issued Jan. 20, 1998 to Ermanno C. Petocchi and Bruce J. DiRenzo; and 5,769,410 issued Jun. 23, 1998 to Harry A. Davidson and Donald J. Lyon (FIG. 3 of which shows the feed roll drive shaft decoupling); and other patents cited therein. The U.S. Pat. No. 5,435,538 in particular teaches details of a frictional elastomer retard roller with an integral wrap spring slip biasing device to retard and separate underlying sheets while the top sheet is being fed out by a driven frictional elastomer feed wheel forming the retard nip by a normal force engagement of the retard roll against the feed roll. The retard roll is allowed to slip rotate in the downstream or forward sheet feeding direction, driven by the rotation of the feed roll, once the predetermined torque drag level is exceeded (in contrast to a fixed retard pad or roller). The rotational torque drag of the retard roll is set to provide considerable resistance to rotation, so that if two or more sheets are in the retard nip, normally only the one sheet engaged by the feed roll will be driven downstream out of the retard nip, and the others will be retarded there. Other retard systems, for driven reverse rotation of retard rollers, instead of springs, are disclosed in U.S. Pat. Nos. 3,108,801, 2,979,330 and 4,801,134.

Further by way of background, in sheet feeder-separator systems, including retard types, the single sheet being fed forward or downstream (while the other sheets are being retarded) is typically fed downstream to a "take-away" rolls nip located less than one sheet dimension downstream. The take-away nip positively engages and pulls the fed sheet on downstream, and may pull the rest of that sheet out of the retard nip (which is typically a less positive sheet engagement system with potential or actual slip, and overdriven or under-driven as compared to the takeaway rollers).

As shown in the example of FIG. 1, the retard separator-feeder embodiment further described herein can be utilized in a document feeder for reliably separating and sequentially feeding a variety of original document sheets to be scanned sequentially in an electronic image scanner. FIG. 1 corresponds in that regard closely to the document handler of Xerox Corporation U.S. Pat. No. 5,534,989 issued Jul. 9, 1996 to Robert F. Rubscha et al.; U.S. Pat. No. 5,461,468 issued Oct. 24, 1995 to Neil J. Dempsey et al.; and U.S. Pat. No. 5,339,139 issued Aug. 20, 1994 to Jack K. Fullerton, et al; but this invention is not limited to that particular application.

The embodiment disclosed herein generally addresses a particular problem in retard feeders, namely, the kickback of the retarded sheet or sheets by the retard system. After a sheet has been fed out of the retard nip, if the next sheets to be fed were being held back by the retard nip, they may be kicked back with enough force as to be ejected backwards or upstream out from the retard nip. Thus those subsequent sheets may not be acquired in the retard nip for feeding out downstream at the proper time.

As further disclosed in the example below, it has been discovered that a large mass, high moment of inertia or angular momentum inertial wheel or "flywheel" can be appropriately connected into the rotational drive train of the feed wheel for the retard nip to reduce the kickback of the retarded sheets. It has been further discovered that this inertial wheel feature can desirably be combined with a light (low force) frictional drive between the drive input to said drive train and the inertia wheel when that drive input is engaged, so as to bias out or take up the "play" or backlash of the drive train in the driving direction to further reduce kickback of the retarded sheets.

To express it another way, in the semi-active retard system disclosed in the embodiment, there is a kickback problem with the underlying sheet(s) when the trail edge area of the fed sheet N being pulled out by the take-away nip finally clears the retard nip. That is, the sheet N+1 (the next, underlying, sheet, that was retarded in the retard nip) is propelled back from the retard nip by the stored energy from the overall retard mechanism, which may include mechanical resiliencies of the sheet feed system and its mounting for the retard nip as well as the retard roll. This sheet kickback, if severe enough, can cause multifeeds or other malfunctions on subsequent feeds, assuming the sheet N+1 is a sheet which had "shingled" in the retard nip with sheet N. Since the feed roll drive is disengaged at that point in time, and since it has a relatively small diameter and mass, although the feed roll is engaged with the retard nip, the feed roll itself heretofore offered little inertial or other resistance to being reverse driven by the kickback forces. As disclosed, it has been discovered that an appropriate inertial wheel that can be mounted at an appropriate location on the feed roll drive shaft can absorb the energy of the kickback by resisting a sudden reverse movement of the feed roll and thus also resist a sudden reverse movement of the retard roll and any retarded sheet(s).

However, due to the drive coupling and other backlash or play in or from the feed roll driving and mounting connections, it has been found highly desirable to also add a light frictional drive between the feed input gear or other drive connection and the inertia wheel in order to bias such freedom of movement or backlash out of the drive train and more directly apply and connect the mass of the inertial wheel to the feed roll.

The same problem could occur even if there was a fixed retard roll or pad. However, as noted, it is exacerbated in the disclosed system where the retard roll is being rotated forward with high resistance as the fed sheet is fed out of the retard nip (first by the feed roll and then by the downstream take-away rolls). The feed rolls must pull against and overcome the drag force set in the retard roller, which may be provided by an internal wrap spring as in the above-cited U.S. Pat. No. 5,435,538. This considerable drag resistance set in the retard roll, e.g., 39 Newton millimeters of torque, is free to react on the underlying N+1 sheet as soon as the first sheet clears the retard nip. In particular, the release of the forward drag on this wrap spring which was previously resisting the forward rotation of the retard roller can rapidly rotate the retard roll backwards slightly. That can push back up upstream the N+1 sheet if there is insufficient resistance in the engaging drive roll. While this retard wrap spring release kickback of the retard roll may be so small as to be effectively invisible to the naked eye, it can impart considerable kickback energy to a typical lightweight paper sheet. As noted above, play or slop in the drive system for the feed roll, as is normally the case, plus elasticity in the mounting systems of the components, can also contribute to the kickback.

In the description herein the term "document", "sheet" or "copy sheet" refers to various flimsy physical sheets of paper, plastic, or other suitable physical substrate for images, whether precut or initially web fed.

A specific feature of the specific embodiment disclosed herein is to provide in a retard sheet feeder-separator system for separating and sequentially feeding individual flimsy print substrate sheets from a stack thereof, said sheet feeder-separator system including a rotatable frictional sheet feeding member, a rotational drive system for said rotatable sheet feeding member, and a sheet movement resisting frictional retard member engaging said sheet feeding member to form a sheet retard nip for retarding sheets other than a sheet being fed by said rotatable sheet feeding member, and a downstream sheet feeding nip to which said rotatable sheet feeding member feeds a sheet downstream out of said sheet retard nip; the improvement comprising: a large moment of inertia flywheel member, and a connection system for connecting said large moment of inertia flywheel member to said rotational drive system for said rotatable sheet feeding member, spaced from said rotatable sheet feeding member, to reduce kickback of said retarded sheets in said retard nip.

Further specific features disclosed herein, individually or in combination, include those wherein said rotational drive system for said rotatable sheet feeding member includes a drive source, a drive train connecting to said rotatable sheet feeding member, and an intermittent sheet feeding drive connection system for intermittently connecting said drive source to said drive train with a large driving force for driving said rotatable sheet feeding member, and wherein said large moment of inertia flywheel member is connected to said drive train; and/or wherein said large moment of inertia flywheel member has a rotational moment of inertia substantially greater than that of said drive train and said rotatable sheet feeding member; and/or further including a low torque connection system connecting said drive source to said drive train with low torque when said intermittent sheet feeding drive connection system is not connecting said drive source to said drive train with said large driving force for driving said rotatable sheet feeding member, to reduce backlash in said drive train between said large moment of inertia flywheel member and said rotatable sheet feeding member; and/or wherein said low torque connection system comprises a low force constant slip frictional drive connection between said drive source and said large moment of inertia flywheel member; and/or wherein said sheet movement resisting frictional retard member is a high torque resistance to rotation retard roller which is rotated with said high torque resistance by a sheet which is in both said retard nip and said downstream sheet feeding nip, and/or wherein said high torque rotational resistance of said retard roller is provided by an integral wrap spring having a kickback force on said retard roller when a sheet in said downstream sheet feeding nip is released from said retard nip.

As to specific components of the subject apparatus, or alternatives thereof, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation shown and described in the example below, and from the abstract and claims. Thus, the present invention will be better understood from this description of one specific exemplary embodiment, including the drawing figures (approximately to scale) wherein:

Figure 1:
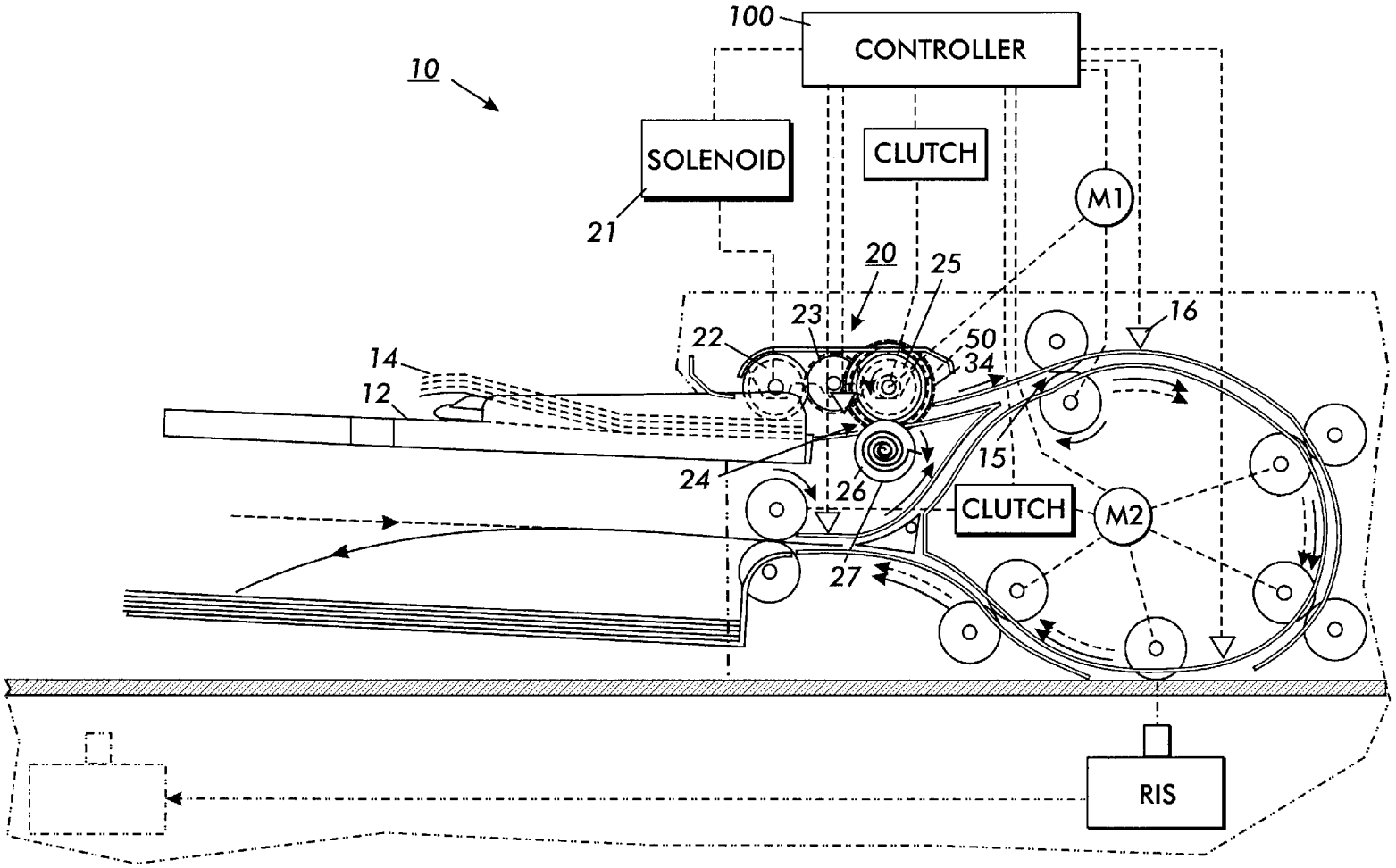
FIG. 1, is a frontal schematic view of an example from an above-indicated prior patent of one document handling system in which an example of the subject sheet separation and feeding system may be incorporated, as shown.
Figure 2:
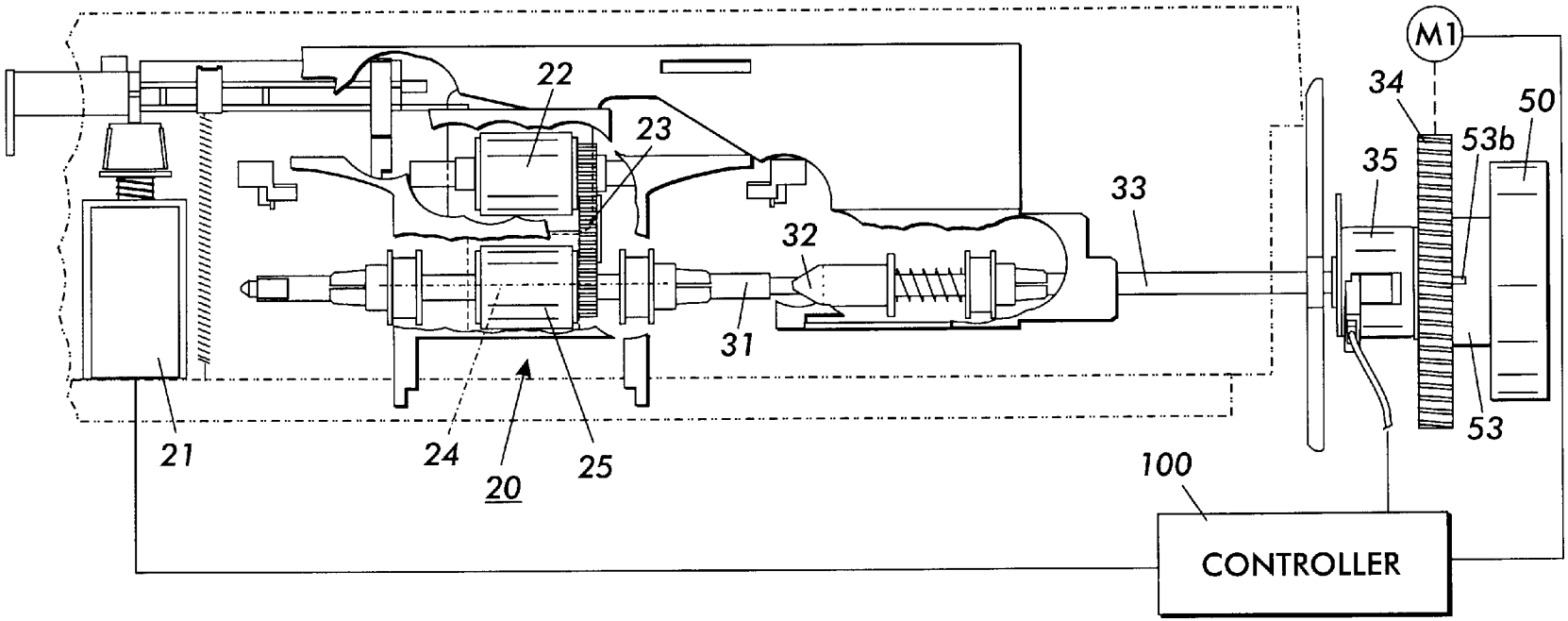
FIG. 2 is an enlarged partial exposed top view, partially broken away, of said exemplary improved sheet separator-feeder system.

In this example of FIGS. 1–5, a document handler 10 of FIG. 1 (more fully described in the above-cited patents thereon) with a document sheet stacking input tray 12 sequentially feeds the top sheets 14 from sheets stacked in that tray 12 with a retard type sheet separator-feeder 20 driven by a motor M1 and conventionally controlled by a controller 100. Briefly, in this separator-feeder 20, a sheet 14 is separated from its underlying sheets, first by an intermittently solenoid 21 engaged nudger roll 22 (driven by gear 23 driven off the drive of the feed roller 25) over the sheet stack. Overlapping sheets are then separated in a retard nip 24. The retard nip 24 here is defined by an underlying retard (drag) roller 26 engaging an intermittently driven feed roller 25. The sheet 14 is then fed downstream by the feed roller 25 to a driven takeaway roller nip 15 (which may also have a sheet acquisition sensor 16). The retard roller 26 may be torque biased for retarding sheets by an internal drag wrap spring 27. The retard system here has a removable snap-in unit comprising the retard roller 26 and the feed roller 25, as further disclosed in the above-cited patents thereon—U.S. Pat. Nos. 5,421,569, 5,709,380 and 5,769,410.

Turning now to FIGS. 2–5, the exemplary improvements in the separator-feeder 20 and its driving and biasing systems are shown in detail. The feed roller drive system 30 comprises a first axial shaft section 31 with a loose removable connection 32 to a second shaft section 33. The shaft section 33 is driven by connection to a drive gear 34 (driven by motor M1) only when an electromagnetic or other such drive clutch 35 is electrically engaged. Here, a metal inertial wheel (flywheel) 50 (to be further described) is also axially mounted to the end of the drive shaft section 33. When the drive clutch 35 is disengaged (which occurs when a sheet is acquired by the downstream take-away rolls nip 15) the drive gear 34 is still being rotatably driven, but is no longer directly connected by the clutch 35 to the drive shafts 31, 33, to drive or control the movement of the feed roller 25. However, as will be described, in this disclosed system, there is then a partial, low torque, connection or light forward driving force which is maintained by a light drag system even when the clutch 35 is disengaged.

Figure 3:
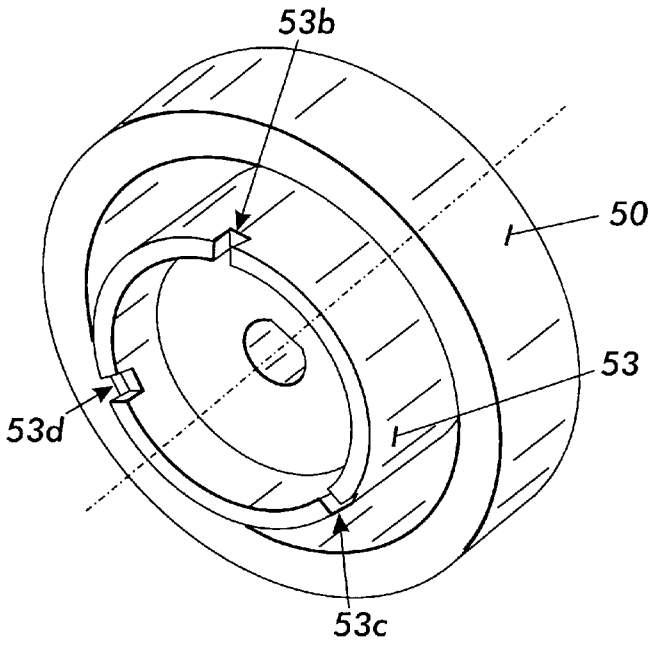
FIG. 3 shows in enlarged perspective the inertial wheel per se of said FIG. 1 and FIG. 2 separator-feeder system with its drag connecting sleeve.
Figure 4:
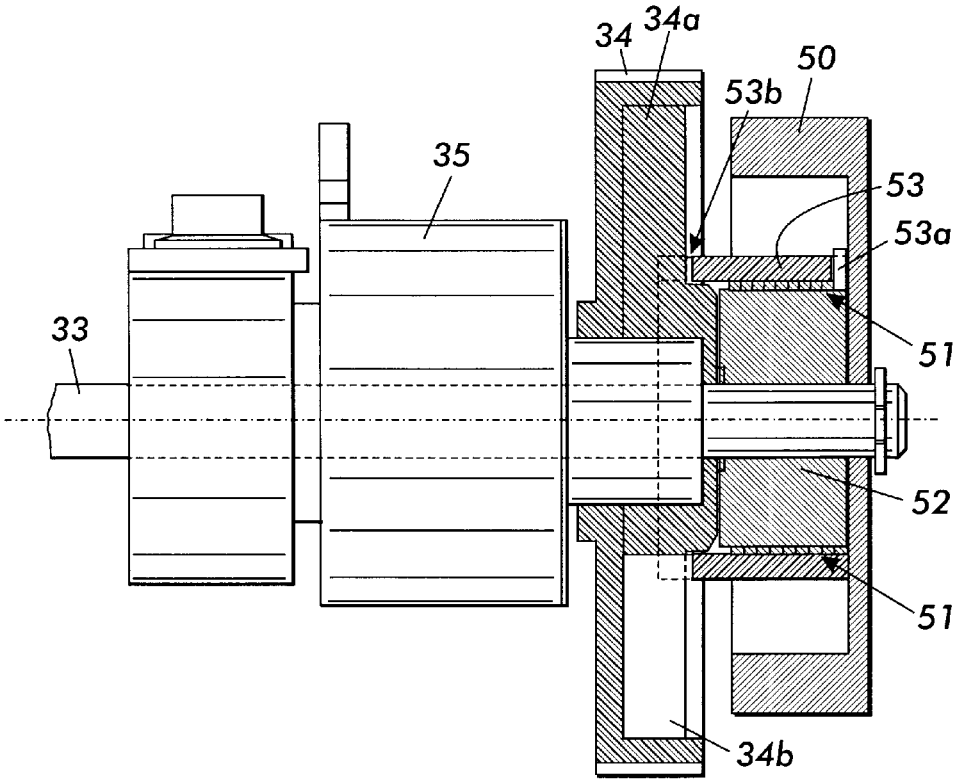
FIG. 4 is an enlarged and partially axially cross-sectioned end view of the inertial wheel, drive gear, and drive clutch, on the drive shaft end, of said FIG. 1, 2 and 3 separator-feeder system.
Figure 5:
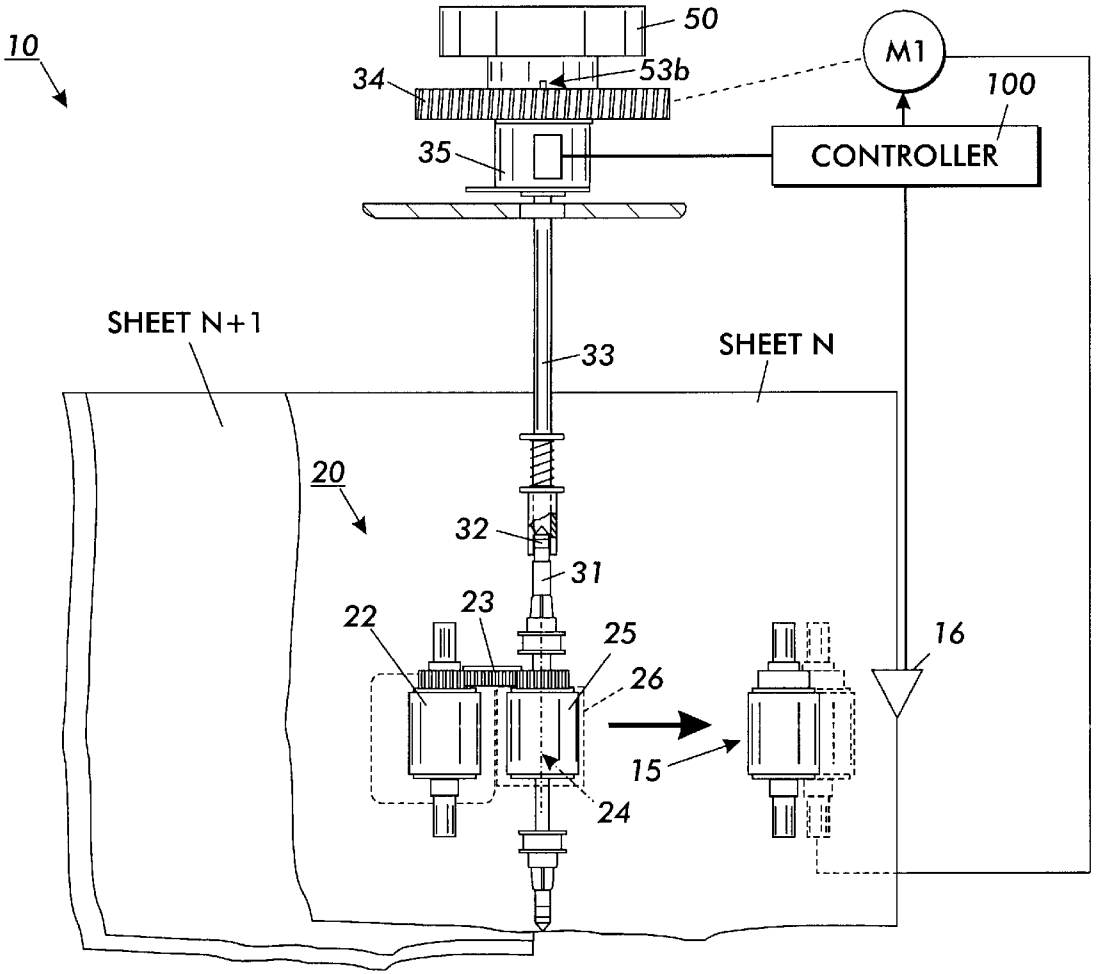
FIG. 5 is a partial schematic top view of said FIG. 1, 2 and 3 separator-feeder system plus the immediately downstream sheet take-away roller nip system.

Specifically, in the embodiment herein, as shown in FIGS. 3 and 4, the desired light driving drag force between the inertial wheel 50 and the driving input from the driving gear 34 is provided through a light wrap spring 51 on a drum or enlarged integral shaft portion 52 of the inertial wheel. The wrap spring 51 is held in between the drum 52 and a separate but closely surrounding nylon or other plastic hollow cylindrical sleeve 53. The outer end of the sleeve 53 has a slot 53*a* that engages the free outer tang end 51*a* of the spring 51. The inner end of the sleeve 53 has three slots 53*b*, 53*c*, 53*d*, which engage and connect with three integral ribs (of which only 34*a* and 34*b* are visible in FIG. 4) of the driving gear 34, so that sleeve 53 is always being rotatably driven by the driving gear 34, even when the clutch 35 has disengaged driving gear 34 from drive shaft 33. The rotational drive of the sleeve 53 acts through the wrap spring 51 drag on the drum 52 to provide a light drag forward biasing on the flywheel 50, which is directly connected to the feed roll drive shaft 33, to take up or reduce the play or backlash in the entire drive train system for the feed roll 25. That is, to bias the shafts 31, 33, their connection 32, the feed roll 25 itself, and the mountings, in the forward or downstream sheet feeding direction.

The inertial wheel 50 is centrally fastened directly to the drive shaft. Here this is by a conventional "D" shaft end mating into an axial "D" aperture in the central axis of the inertial wheel 50, thereby coupling the mass of the inertial wheel or flywheel 50 directly to the above-described drive shaft system for the feed roll 25 in the retard nip 24.

The large mass, diameter, angular momentum and rotational moment of inertia of the inertial wheel 50 is preferably considerably greater than that of all the other elements of the entire feed wheel drive chain, that is, the much smaller diameters and smaller masses of the feed roller 25 and its drive train 31, 32, 33. However, the specific inertial wheel 50 mass and diameter is not critical. Furthermore, the inertial wheel 50 here is desirably located out at the outer end of the drive shafts, well away from the retard nip, since there is insufficient room for a suitably sized and weighted flywheel in the retard nip area or paper path area here.

To recap, in the disclosed system embodiment, the driving gear 34 is always being rotatably driven by the drive motor M1, but it is not connected to the drive train 31, 32, 33 for the feed roll 25 unless it is clutched in by electrical clutch 35. When that drive clutch 35 engages, the drive gear 34 is then connected directly to the drive shaft 33, driving the feed roll 25. When clutch 35 is disengaged, the flywheel 50 is only connected to drive gear 34 through its own wrap spring 51 slip clutch arrangement described above, for a low force drag coupling. However, the flywheel 50 mass is always connected directly to the drive wheel shaft 33 even when the clutch 35 is not engaged. The drive gear 34 is rotating faster than the feed roll 25 when the drive clutch 35 is not engaged. When the drive clutch 35 disengages, the flywheel 50 can slip relative to the driving gear 34, but is still being urged to rotate faster through its low friction slip connection since the driving gear 34 is rotating faster than the shaft 33 at that point. This continuously takes up the "play" or "slop" in the system, that is, biasing the drive shaft 33 forward to take up the loose connections and other backlash in the system.

Re-describing the sheet feeding operation, after sheet N (sheet one) has been fed out into the takeaway rolls nip 15, a sensor 16 at that or another position indicates that the sheet N lead edge has been acquired by the takeaway nip 15 and provides a signal for turning off (disengaging) the drive clutch 35 from the feed gear 34 to the feed roller shaft 33. The rest or rear trailing portion of sheet N is still in the retard nip at that point, since the space between the retard nip 24 and the takeaway roller nip 15 is less than one sheet length in the feeding direction. Thus, the rear portion of the sheet N is now being pulled out from the retard nip 24 by the takeaway roll nip 15. Since the feed roll shaft 33 has been de-clutched from its drive at this point, the feed roll 25 is now free rotating, and the feeding out of the trail edge of the first sheet is resisted only by the retard roll 26 drag torque. At that point the retard roll 26 is also holding back the second or N+1 and any subsequent sheets that were being retarded in the retard nip 24. As noted, the retard roll 26 slips (rotates in the forward direction) only with a relatively high torque, approximately 39 Newton-millimeters of torque, due to the drag force relative to the retard roller mounting shaft provided by its internal retard wrap spring 27. Thus, when the trail edge of the first sheet is pulled completely free of the retard nip, the retard roll is free to unwind backwards slightly due to its internal wrap spring force. Thus, there is a small but significant kickback by the retard roll of the retarded second and/or subsequent sheets from the stored energy and elasticity in the system. That includes both the above-noted retarded drag torque and the structural elasticity of the system and its mountings.

However, in the improved system disclosed here, since the retard roll is in engagement with the feed wheel directly at that point (with no sheet in the retard nip), any sudden change in the rotational velocity of the retard roll, or other movement thereof, will be resisted by the rotational inertia of the flywheel, since the connection play or backlash between the feed roll and the inertial wheel has been taken up previously by the above-described low force slippage drive connection. (Or other such connections to the driven end of the feed wheel drive system.)

While the embodiments disclosed herein are preferred, it will be appreciated from this teaching that various alternatives, modifications, variations or improvements therein may be made by those skilled in the art, which are intended to be encompassed by the following claims. For example, frictional elastomer belts may be usable in lieu of one or of the above-described rollers.

What is claimed is:

1. In a retard sheet feeder-separator system for separating and sequentially feeding individual flimsy print substrate sheets from a stack thereof, said sheet feeder-separator system including a rotatable frictional sheet feeding member, a rotational drive system for said rotatable sheet feeding member, and a sheet movement resisting frictional retard member engaging said sheet feeding member to form a sheet retard nip for retarding sheets other than a sheet being fed by said rotatable sheet feeding member, and a downstream sheet feeding nip to which said rotatable sheet feeding member feeds a sheet downstream out of said sheet retard nip; the improvement comprising:

a large moment of inertia flywheel member, and a connection system for connecting said large moment of inertia flywheel member to said rotational drive system for said rotatable sheet feeding member, spaced from said rotatable sheet feeding member, to reduce kickback of said retarded sheets in said retard nip.

2. The retard sheet feeder-separator system of claim 1, wherein said rotational drive system for said rotatable sheet feeding member includes a drive source, a drive train connecting to said rotatable sheet feeding member, and an intermittent sheet feeding drive connection system for intermittently connecting said drive source to said drive train with a large driving force for driving said rotatable sheet feeding member, and wherein said large moment of inertia flywheel member is connected to said drive train.

3. The retard sheet feeder-separator system of claim 2, wherein said large moment of inertia flywheel member has a rotational moment of inertia substantially greater than that of said drive train and said rotatable sheet feeding member.

4. The retard sheet feeder-separator system of claim 2, further including a low torque connection system connecting said drive source to said drive train with low torque when said intermittent sheet feeding drive connection system is not connecting said drive source to said drive train with said large driving force for driving said rotatable sheet feeding member, to reduce backlash in said drive train between said large moment of inertia flywheel member and said rotatable sheet feeding member.

5. The retard sheet feeder-separator system of claim 4, wherein said low torque connection system comprises a low force constant slip frictional drive connection between said drive source and said large moment of inertia flywheel member.

6. The retard sheet feeder-separator system of claim 1, wherein said sheet movement resisting frictional retard member is a high torque resistance to rotation retard roller which is rotated with said high torque resistance by a sheet which is in both said retard nip and said downstream sheet feeding nip.

7. The retard sheet feeder-separator system of claim 1, wherein said high torque rotational resistance of said retard roller is provided by an integral wrap spring having a kickback force on said retard roller when a sheet in said downstream sheet feeding nip is released from said retard nip.

* * * * *